US010745652B2

(12) United States Patent
Henderson Villalpando et al.

(10) Patent No.: US 10,745,652 B2
(45) **Date of Patent: *Aug. 18, 2020**

(54) DISHWASHING PASTES

(71) Applicant: Colgate-Palmolive Company, New York, NY (US)

(72) Inventors: Joshua Gerardo Henderson Villalpando, Mexico City (MX); Ammanuel Mehreteab, Yardley, PA (US); Lidia Venegas, Mexico City (MX); Margarita Zapata Menchaca, Mexico City (MX); Arianis Riofrio, Mexico City (MX); Mario Alejandro Herrera Lazo De La Vega, Querétaro (MX); Santiago Salas, Mexico City (MX)

(73) Assignee: Colgate-Palmolive Company, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/448,038

(22) Filed: Jun. 21, 2019

(65) Prior Publication Data

US 2019/0367848 A1 Dec. 5, 2019

Related U.S. Application Data

(63) Continuation of application No. 15/182,475, filed on Jun. 14, 2016, now Pat. No. 10,370,624.

(60) Provisional application No. 62/271,841, filed on Dec. 28, 2015.

(51) Int. Cl.

| | |
|---|---|
| ***C11D 17/00*** | (2006.01) |
| ***C11D 3/08*** | (2006.01) |
| ***C11D 3/12*** | (2006.01) |
| ***C11D 1/14*** | (2006.01) |
| ***C11D 1/22*** | (2006.01) |
| ***C11D 1/29*** | (2006.01) |
| ***C11D 1/75*** | (2006.01) |
| ***C11D 3/04*** | (2006.01) |
| ***C11D 3/10*** | (2006.01) |
| ***C11D 3/14*** | (2006.01) |

(52) U.S. Cl.

CPC ..... *C11D 17/003* (2013.01); *C11D 1/146* (2013.01); *C11D 1/22* (2013.01); *C11D 1/29* (2013.01); *C11D 1/75* (2013.01); *C11D 3/046* (2013.01); *C11D 3/08* (2013.01); *C11D 3/10* (2013.01); *C11D 3/1233* (2013.01); *C11D 3/1246* (2013.01); *C11D 3/14* (2013.01)

(58) Field of Classification Search

CPC ..... C11D 1/146; C11D 1/22; C11D 1/29

See application file for complete search history.

(56) References Cited

U.S. PATENT DOCUMENTS

| | | | | |
|---|---|---|---|---|
| 3,131,995 | A | 5/1964 | Gonze et al. | |
| 4,263,048 | A | 4/1981 | Hacker | |
| 5,637,758 | A * | 6/1997 | Sajic | C11D 1/28 560/147 |
| 6,225,272 | B1 * | 5/2001 | Giesen | C11D 1/94 510/235 |
| 2003/0100464 | A1 * | 5/2003 | Kott | C11D 1/37 510/357 |
| 2004/0110657 | A1 * | 6/2004 | Strothoff | C11D 1/825 510/426 |
| 2008/0214776 | A1 * | 9/2008 | Bigorra Llosas | C07C 219/06 528/335 |
| 2017/0183608 | A1 * | 6/2017 | Salas | C11D 3/1233 |

FOREIGN PATENT DOCUMENTS

| | | | | |
|---|---|---|---|---|
| CA | 1128257 | | 7/1982 | |
| DE | 19751151 | A1 * | 5/1999 | C11D 1/835 |
| GB | 2068403 | | 8/1981 | |
| IL | 53580 | | 1/1981 | |
| WO | 2001/042413 | | 6/2001 | |
| WO | 2011/084780 | | 7/2011 | |
| WO | WO-2011084780 | A1 * | 7/2011 | C11D 3/323 |
| WO | 2014/044639 | | 3/2014 | |
| WO | WO-2014044639 | A2 * | 3/2014 | |

* cited by examiner

*Primary Examiner* — Mark Eashoo
*Assistant Examiner* — M. Reza Asdjodi

(57) ABSTRACT

Described herein, are dishwashing paste compositions comprising: an abrasive; a pH modifying agent in an amount effective to provide a pH greater than 7; a structuring agent; and a source of polyvalent cations. Methods of making and using these compositions are also described.

12 Claims, No Drawings

DISHWASHING PASTES

CROSS-REFERENCE TO RELATED APPLICATIONS

This application claims priority to U.S. Provisional Patent Application Ser. No. 62/271,841, filed on Dec. 28, 2015, which is incorporated by reference herein in its entirety.

BACKGROUND

Conventional dishwashing pastes are liquid or gel-like compositions that are suitable for forming hardened dishwashing agents that have a similar look and feel to that of a bar of soap. Once the pastes are formed, their chemistry allows them to harden to a desired hardness level for packaging and sale to customers. Such hardened dishwashing agents are popular in the developing world.

Current dishwashing paste compositions are typically formed of a high amount of abrasive/filler material, such as calcium carbonate, that is suspended in a viscous solution which includes surfactant(s), sodium carbonate, and sodium silicate, as well as other additives. The surfactants provide the foaming and cleansing properties of the dishwashing agent, while the sodium carbonate helps to adjust the pH level of the formula. The sodium silicate is the primary component that allows the composition to harden by providing silica that polymerizes when mixed with the other components.

Dishwashing pastes typically must achieve some desired level of hardness after they are packaged and before they are sold to consumers, which is generally about 5 mm penetrability. On the other hand, the pastes should not harden to such an extent over time that they exceed the threshold hardness value, or they will develop a "rock-like" texture and become unsuitable for their intended use. The mechanism by which conventional dishwashing paste compositions achieve the desired level of hardness is through the polymerization of silica, as alluded to above. The primary cation component present in conventional formulas is a monovalent sodium cation. The alkaline pH of the composition (modified by the sodium carbonate) causes the silica surface charge to become more negative by hydroxyl ion adsorption, as well as by surface silanol group ionization. These changes in the silica surface cause mutual repulsion between the colloidal silica particles present in the solution, thus slowing their polymerization. The monovalent sodium cation allows polymerization to occur by shielding the negative charge. However, current polymerization processes are slow and inefficient, and some conventional hardened dishwashing agents have a tendency to over-harden, resulting in rock-like texture through the time, which is not well perceived by the consumers.

To solve this problem, dishwashing paste compositions have been prepared in the industry that achieve the requisite level of hardness without developing "rock-like" texture. However, these formulas tend to increase the quarantine time required for the formula to reach the desired level of hardness. This is undesirable because it requires increased inventories at manufacturing sites, reducing inventory rotation and thus increasing associated manufacturing costs.

As such, a dishwashing paste composition that achieves a target hardness more quickly, while maintaining that hardness for an extended period of time thereafter without developing a "rock-like" texture is desired.

BRIEF SUMMARY

Accordingly, in some embodiments, the present invention is directed to dishwashing paste compositions that comprise at least one salt of polyvalent cation that provides free polyvalent cations to the composition. The presence of these free polyvalent cations produces a quicker and more effective polymerization process than the monovalent cations in traditional dishwashing paste compositions, thus reducing the quarantine time needed to form the hardened dishwashing composition and avoiding the development of "rock-like" texture. The dishwashing paste compositions of the invention achieve a hardness of 5-8 mm in five (5) days or less after manufacturing.

In some embodiments, the present invention provides a dishwashing paste composition comprising from about 20 wt. % to about 50 wt. % of an abrasive, a pH modifying agent in an amount effective to provide a pH greater than 7, from about 1 wt. % to about 10 wt. % of a structuring agent, and from about 0.1 wt. % to about 5 wt. % of a source of polyvalent cations, wherein the dishwashing paste composition has a penetrability of less than about 8 mm after 3 days, and wherein the dishwashing paste composition maintains a penetrability of greater than about 3 mm after about 90 days.

The foregoing and/or other aspects and utilities embodied in the present disclosure may be achieved by providing a dishwashing paste composition, including from about 20 wt. % to about 50 wt. % of an abrasive; a pH modifying agent in an amount effective to provide a pH greater than about 7; from about 1 wt. % to about 10 wt. % of a structuring agent; and from about 0.1 wt. % to about 5 wt. % of a source of polyvalent cations.

In another embodiment, the dishwashing paste composition has a penetrability of less than about 8 mm after 3 days.

In another embodiment, the dishwashing paste composition maintains a penetrability of greater than about 3 mm after about 90 days.

In another embodiment, the dishwashing paste composition includes from about 30 wt. % to about 40 wt. % of an abrasive.

In another embodiment, the pH modifying agent is selected from sodium carbonate, sodium bicarbonate, and a combination thereof.

In another embodiment, the dishwashing paste composition includes from about 1.5 wt. % to about 7.5 wt. % of a structuring agent.

In another embodiment, the dishwashing paste composition includes from about 2 wt. % to about 6 wt. % of a structuring agent.

In another embodiment, the structuring agent comprises sodium silicate.

In another embodiment, the molar ratio of pH modifying agent to structuring agent is greater than about 4:1.

In another embodiment, the molar ratio of pH modifying agent to structuring agent is about 4.4:1 or greater.

In another embodiment, the source of polyvalent cations comprises an alkaline earth metal salt.

In another embodiment, the alkaline earth metal salt is selected from magnesium chloride, calcium chloride, and a combination thereof.

In another embodiment, the dishwashing paste composition includes from about 0.25 wt. % to about 3 wt. % of the source of polyvalent cations.

In another embodiment, the molar ratio of the source of polyvalent cations to structuring agent is from about 1:1 to about 2:1.

In another embodiment, the molar ratio of the source of polyvalent cations to structuring agent is about 1.7:1.

In another embodiment, the dishwashing paste composition includes a surfactant system.

In another embodiment, the surfactant system comprises a surfactant selected from: sodium $C_{10}$-$C_{13}$ alkylbenzenesulfonate; magnesium $C_{10}$-$C_{13}$ alkylbenzenesulfonate (linear); lauryl/myristylamidopropyl dimethylamine oxide; sodium laureth sulfate; sodium lauryl sulfate; and a combination of two or more thereof.

In another embodiment, the surfactant system includes from about 5 wt. % to about 20 wt. % sodium $C_{10}$-$C_{13}$ alkylbenzenesulfonate (linear) and from about 1 wt. % to about 5 wt. % of magnesium $C_{10}$-$C_{13}$ alkylbenzenesulfonate (linear).

In another embodiment, the dishwashing paste composition provides a penetrability of less than 6 mm after 7 days.

In another embodiment, the dishwashing paste composition provides a penetrability of about 4 mm after about 90 days.

The foregoing and/or other aspects and utilities embodied in the present disclosure may be also achieved by providing a method of manufacturing a dishwashing paste composition, including providing an abrasive, a pH modifying agent, a structuring agent; and a source of polyvalent cations; admixing the abrasive, the pH modifying agent, the structuring agent; and the source of polyvalent cations in amounts sufficient to provide a pH of greater than about 7, and for a time sufficient to ensure intimate contact between the structuring agent and the source of polyvalent cations; wherein the dishwashing paste composition has a penetrability of less than about 8 mm after 3 days.

In another embodiment, the dishwashing paste composition maintains a penetrability of greater than about 3 mm after about 90 days.

In another embodiment, the time sufficient to ensure intimate contact between the structuring agent and the source of polyvalent cations, is sufficient to ensure silica polymerization.

In another embodiment, the structuring agent comprises sodium silicate, wherein the source of polyvalent cations comprises an alkaline earth metal salt, and wherein the alkaline earth metal salt is selected from magnesium chloride, calcium chloride, and a combination thereof.

The foregoing and/or other aspects and utilities embodied in the present disclosure may be achieved by providing an oral care composition substantially as hereinbefore described, with reference to the examples and excluding, if any, comparative examples.

DETAILED DESCRIPTION

In some embodiments, the dishwashing paste compositions disclosed herein may comprise calcium carbonate, sodium carbonate, sodium silicate, and a source of polyvalent cations. According to another embodiment, the dishwashing paste composition may further comprise additives which adjust the hardness, provide additional surfactant properties, and/or adjust the color and fragrance of the resulting hardened dishwashing agent.

In some embodiments, the dishwashing paste composition comprises about 20-40 wt % calcium carbonate, optionally about 30-40 wt %, based upon the total weight of the dishwashing paste composition. Preferably, the calcium carbonate is provided in a separate solid phase from the rest of the components of the paste composition. In some embodiments, the calcium carbonate provides a mild abrasive property to the composition, acts as a filler, reduces the tackiness of the composition, and provides a smoothness to the resulting bar-like product.

In other embodiments, the dishwashing paste composition further comprises about 20-40 wt % water, optionally about 20-35 wt %, further optionally about 25-35 wt %, based upon the total weight of the dishwashing paste composition. In some embodiments, the water component provides a medium by which the components may be mixed and functions to modify the hardness, tackiness, and sheen of the resulting hardened agent.

In some embodiments, the dishwashing paste compositions of the present invention comprise from about 5 to about 20 wt % of a pH modifying agent. In other embodiments, the dishwashing paste compositions of the present invention comprise from about 5 to about 20 wt % sodium carbonate, optionally about 5 to about 15 wt %; further optionally about 10 to about 15 wt %, based upon the total weight of the dishwashing composition. In some embodiments, the sodium carbonate can modify the hardness of the resulting composition, while also serving as a pH modifying agent. In some embodiments, the dishwashing paste composition comprises an effective amount of a pH modifying agent, e.g., sodium carbonate, sodium bicarbonate, and combinations thereof, to provide a pH of greater than about 7.

In some embodiments, sodium silicate is added to the dishwashing paste composition to create a network. In some embodiments, the sodium silicate serves as a structuring agent that assists in keeping the solids in suspension, while also providing a certain level of hardness. In some embodiments, sodium silicate provides the silica that is polymerized according to the processes set forth herein. In some embodiments, sodium silicate forms siloxane bonds (Si—O—Si) from silanol groups at the surface of the silicate oligomers (Si—OH) in condensation polymerization (≡Si-OH+HO-SI≡<⟷>≡Si—O—Si≡+H2O). This continues until a network of such links is formed throughout the formula. In some embodiments, the sodium silicate is provided in an amount of from about 1 to about 10 wt %, optionally from about 1.5 to about 7.5 wt %; further optionally from about 2 to about 6 wt %.

Other embodiments provide a dishwashing paste composition wherein the molar ratio of pH modifying agent to structuring agent is greater than about 4:1, preferably about 4.4:1 or greater.

In some embodiments, the dishwashing paste composition further comprises from about 10 to about 40 wt %, optionally from about 10 to about 30 wt %, of at least one surfactant that provides the cleaning and foaming properties of the composition, based upon the total weight of the dishwashing paste composition. In some embodiments, the surfactant may include one or more types of surfactants, such as, for example, sodium $C_{10}$-$C_{13}$ alkylbenzenesulfonate, magnesium $C_{10}$-$C_{13}$ alkylbenzenesulfonate, lauryl/myristylamidopropyl dimethylamine oxide, sodium laureth sulfate, sodium lauryl sulfate, or combinations thereof. In some embodiments, the dishwashing paste composition comprises from about 10 to about 20 wt % of at least one of sodium $C_{10}$-$C_{13}$ alkylbenzenesulfonate and magnesium $C_{10}$-$C_{13}$ alkylbenzenesulfonate. In other embodiments, the surfactant comprises at least from about 5 to about 20 wt % of sodium $C_{10}$-$C_{13}$ alkylbenzenesulfonate and from about 1 to about 5 wt % of magnesium $C_{10}$-$C_{13}$ alkylbenzenesulfonate. If present, other surfactant materials are preferably provided in an amount of about 5 wt % or less, based upon the total weight of the dishwashing composition.

In some embodiments, the dishwashing paste composition further comprises from about 0.1 to about 5 wt % of a source of polyvalent cations, optionally from about 0.25 to about 3 wt %, further optionally from about 0.4 to about 2 wt %, based upon the total weight of the dishwashing paste composition.

In some embodiments, the source of polyvalent cations comprises an alkaline earth metal salt. In other embodiments, the source of polyvalent cations is a magnesium chloride salt, a calcium chloride salt, or a combination thereof. Without being bound by theory, it is believed that the inclusion of the magnesium chloride salt delivers free polyvalent cations to the aqueous fraction of the formula (i.e., water, sodium carbonate, and sodium silicate) which more effectively polymerizes the silica component of the composition within the first few days of its manufacture, thus reducing quarantine times from 7-11 days, as observed with conventional dishwashing paste compositions, to as low as 3 days. They achieve this increased efficiency in polymerization because they can be adsorbed on the surface of the amorphous silica, neutralize a single negative charge, and leave a net positive charge at that site. Additionally, the resulting hardened dishwashing agent can achieve a stable hardness value of about 5-8 mm penetrability (as measured with a penetrometer) in five (5) days or less, which is maintained for at least 3 months after production. Another benefit of the inclusion of the magnesium chloride salt is that the amount of sodium carbonate, which also functions as a hardness modifier, may be reduced, thus lowering manufacturing costs.

In some embodiments, the molar ratio of the source of polyvalent cations to structuring agent is greater than about 1:1, preferably about 1:1 to about 2:1, and more preferably about 1.7:1.

As set forth above, the dishwashing paste compositions may further include at least one additive to achieve a variety of functions. For example, sodium bicarbonate may be added in an amount of less than about 0.5 wt %, preferably about 0.1 wt %, to function as a pH buffer and a hardness modifier. Glycerin may be added to provide hygroscopic properties, and to act as a moisturizer for the resulting composition. If present, glycerin is provided in an amount of less than about 2 wt %, preferably about 1.5 wt %. Fragrances and colorants may also be added to the composition to increase consumer appeal in amounts of about 1 wt % or less, preferably about 0.5 wt % or less, and most preferably about 0.2 wt % or less. The total amount of additional additive component is preferably about 0.1 wt %. All of the weight percentages set forth herein are based upon the total weight of the dishwashing paste composition.

To form the dishwashing paste composition, each of the above-referenced components are mixed, typically in a sigma mixer, amalgamator, Hobart mixer, crutcher or other known type of mixer. To ensure that silica polymerization occurs, it is recommended that the mixing time be such that the silica anions make sufficient contact with the polyvalent cations.

In some embodiments, the present invention provides a method of making a dishwashing paste composition, comprising the steps of: providing an abrasive, a pH modifying agent, a structuring agent; and a source of polyvalent cations; admixing the abrasive, the pH modifying agent, the structuring agent; and the source of polyvalent cations in amounts sufficient to provide a pH of greater than about 7, and for a time sufficient to ensure intimate contact between the structuring agent and the source of polyvalent cations; wherein the dishwashing paste composition has a penetrability of less than about 8 mm after 3 days; and wherein the dishwashing paste composition maintains a penetrability of greater than about 3 mm after about 90 days. In some embodiments, the structuring agent comprises sodium silicate. In other embodiments, the source of polyvalent cations comprises an alkaline earth metal salt. Still further embodiments provide embodiments wherein the alkaline earth metal salt is selected from magnesium chloride, calcium chloride, and a combination thereof. Yet other embodiments provide methods wherein the time sufficient to ensure intimate contact between the structuring agent and the source of polyvalent cations, is also sufficient to ensure polymerization of the silica (or silicate).

The invention will now be described in conjunction with the following, non-limiting examples.

EXAMPLES

Example 1

Eight exemplary dishwashing paste compositions (Ex. 1-8) are prepared according to the compositions set forth in Table 1 below. Two reference compositions (C1-C2) are also prepared. All amounts are provided in weight percent, based upon the total weight of the dishwashing paste composition.

TABLE 1

| Ingredient | C1 | Ex. 1 | Ex. 2 | Ex. 3 | Ex. 4 | C2 | Ex. 5 | Ex. 6 | Ex. 7 | Ex. 8 |
|---|---|---|---|---|---|---|---|---|---|---|
| Calcium carbonate | 37.40 | 37.15 | 34.92 | 36.43 | 35.59 | 33.63 | 38.23 | 36.86 | 33.63 | 33.63 |
| Sodium C10-C13 alkylbenzenesulfonate (linear) | 15.96 | 15.49 | 6.19 | 15.49 | 6.19 | 6.19 | 6.19 | 6.19 | 6.19 | 6.19 |
| Magnesium C10-C13 alkylbenzenesulfonate (linear) | 1.65 | 1.55 | 4.06 | 1.55 | 4.06 | 4.06 | 4.06 | 4.06 | 4.06 | 4.06 |
| Sodium silicate | 3.56 | 3.56 | 4.00 | 3.56 | 4.00 | 4.00 | 4.00 | 4.00 | 4.00 | 4.00 |
| Sodium carbonate | 9.75 | 10.73 | 12.68 | 10.73 | 12.68 | 12.68 | 12.68 | 12.68 | 12.68 | 12.68 |
| Magnesium chloride - as anyhydrous | — | — | 0.59 | 0.40 | 1.14 | — | 0.46 | 1.84 | 0.46 | 1.84 |
| Calcium chloride - anhydrous | — | 1.81 | — | — | — | — | — | — | — | — |
| Glycerin | 1.50 | 1.50 | 1.50 | 1.50 | 1.50 | 1.50 | 1.50 | 1.50 | 1.50 | 1.50 |
| Lauryl/ Myristylamidopropyl Dimethylamine Oxide | 0.83 | 0.83 | 1.00 | 0.83 | 1.00 | 1.00 | 1.00 | 1.00 | 1.00 | 1.00 |
| Sodium laureth sulfate | 0.73 | 0.73 | — | 0.73 | — | — | — | — | — | — |
| Sodium lauryl sulfate | — | — | 3.19 | — | 3.19 | 3.19 | 3.19 | 3.19 | 3.19 | 3.19 |
| Water, Fragrance, Color | Q.S. | Q.S. | Q.S. | Q.S. | Q.S. | Q.S. | Q.S. | Q.S. | Q.S. | Q.S. |

Examples 1-8 are prepared for hardness testing. Hardness testing is performed using a penetrometer with a 102.5° cone, whereby penetration by gravity is measured by releasing the cone at the surface level and measuring the mm of penetration after 10 seconds.

Table 2 (below) describes the hardness profiles of two of the exemplary compositions (Ex. 1 and Ex. 4) of the present invention and three comparative examples (having no magnesium chloride component). As demonstrated by the data described in Table 4, the exemplary compositions of the present invention provide the desired quarantine time and are able to maintain the desired hardness over an extended period of time (90+ days); whereas the comparative compositions are either unable to harden as quickly as desired and/or cannot maintain the desired level of hardness for an extended period of time (90+ days). With respect to C1 and C4, there are no measurements for day 0 or day 3 because the penetrability was too high at these points in time.

TABLE 2

| Day | Ex. 1 | Ex. 4 | C1 | C3 | C4 |
|---|---|---|---|---|---|
| | Penetrability (mm) | | | | |
| 0 | 16.1 | 16.7 | N/A | 25.8 | N/A |
| 3 | 5.4 | 7.4 | N/A | 22.8 | N/A |
| 7 | 5.0 | 5.8 | 8.9 | 2.8 | 4.8 |
| 91 | 3.7 | 4* | 3.1 | 1.4 | 1.5 |

*Specific measurement not taken on day 91. Value calculated from readings taken on days 82 and 96.

Examples 5-8 are tested for hardness (penetrability) over an extended period of time. Each of Examples 5-8 obtained hardness values below 8 mm in five (5) days or less, while the Control C2 took over 50 days to reach the same hardness value. Additionally, Example 8 remained relatively soft (still below 8 mm penetrability), but also maintained steady hardness over an extended period of time as compared to Control C2.

The foaming test is performed by mechanically shaking a glass cylinder with 100 mL of solution of each sample. No significant difference in the foam stability of the exemplary compositions was shown as compared to the controls, even though the presence of the magnesium cations in the exemplary compositions was expected to affect the water hardness and thus reduce foaming. This result was truly unexpected.

Example 2

To ascertain the immediate effect of incorporating divalent cations (from magnesium chloride) into dishwashing paste compositions, as opposed to monovalent cations (from sodium chloride), five exemplary compositions are prepared (Examples 9-13). Examples 9-11 are prepared with magnesium chloride hexahydrate and Examples 12-13 are prepared with a sodium chloride component. The compositions of Examples 9-13 are set forth in Table 3 below.

TABLE 3

| | #9 | #10 | #11 | #12 | #13 |
|---|---|---|---|---|---|
| Water - (Added) | 28.76 | 27.28 | 24.32 | 28.54 | 26.84 |
| Sodium silicate - (Added) | 3.56 | 3.56 | 3.56 | 3.56 | 3.56 |
| Sodium carbonate - (Added) | 8.03 | 8.03 | 8.03 | 8.03 | 8.03 |
| Magnesium chloride - hexahydrate (Added) | 1.48 | 2.96 | 5.92 | 1.70 | 3.40 |
| Water | 68.76 | 65.21 | 58.13 | 68.23 | 64.15 |
| Sodium silicate | 8.51 | 8.51 | 8.51 | 8.51 | 8.51 |
| Sodium carbonate | 19.19 | 19.19 | 19.19 | 19.19 | 19.19 |
| Magnesium chloride | 3.54 | 7.09 | 14.17 | — | — |

TABLE 3-continued

| | #9 | #10 | #11 | #12 | #13 |
|---|---|---|---|---|---|
| Sodium chloride | — | — | — | 4.07 | 8.15 |
| Molar ratio: sodium carbonate/sodium silicate | 4.42 | 4.42 | 4.42 | 4.42 | 4.42 |
| Molar ratio: polyvalent cation/sodium silicate | 0.43 | 0.85 | 1.70 | — | — |
| Molar ratio: monovalent cation/sodium silicate | — | — | — | 1.70 | 3.40 |

The above compositions are prepared as follows. Magnesium hydroxide solution in water is added into a reactor. Caustic soda solution or optionally sodium carbonate solution, sulfonic acid and water are then slowly added into the reactor until homogeneous. The pH is measured and then adjusted with sulfonic acid or caustic soda as necessary to assure sodium $C_{10}$-$C_{13}$ LAS and magnesium $C_{10}$-$C_{13}$ LAS are completely formed and solids are checked and adjusted with water. The composition is then stored before being used, and finally mixed with the rest of the ingredients for the consecutive operations on a double Blade Sigma Mixer design where blades rotate in opposite directions creating an internal eight figure flow pattern. Other kinds of mixing equipment, such as Crutchers or Amalgamators used to mix and homogenize wet, paste-like and high viscous products can be used. The previous composition is added into the sigma mixer. Agitation is started while adding water and sodium carbonate. Water, colors, sodium lauryl sulfate, lauril/myristyl amidopropyl dimethyl amine oxide, glycerin and other desired ingredients used for claims as natural extracts are mixed in followed by calcium carbonate, magnesium chloride solution and silicate. Finally, the fragrance is added.

It is observed that a desired gel-like phase forms immediately for Examples 9-11 (those including the polyvalent cations). On the other hand, immediately after mixing the components of Examples 12-13, it is observed that they do not form a gel-like phase and instead dissolve into a clear solution. Examples 12-13 had to rest for 8-12 hours before hard crystals are formed, but a gel-like phase never developed. This immediate gel-like phase is desirable because it has a "softer" consistency than the hard crystals which formed in Examples 12-13, which allows it to avoid developing a "rock-like" texture while stored on the store shelf.

Example 3

In order to determine the effect of including divalent cations on the resulting hardness of a dishwashing agent, six additional exemplary dishwashing pastes are prepared (Examples 14-19). Examples 14-19 each include either anhydrous magnesium chloride or anhydrous calcium chloride (providing divalent cations). A control paste composition (C5) was also prepared (providing monovalent cations). The compositions of these pastes are set forth in Table 4 below.

TABLE 4

| | C5 | #14 | #15 | #16 | #17 | #18 | #19 |
|---|---|---|---|---|---|---|---|
| Calcium carbonate | 36.43 | 36.43 | 36.43 | 38.42 | 38.67 | 37.15 | 33.91 |
| Sodium $C_{10}$-$C_{13}$ LAS | 15.49 | 15.49 | 15.49 | 15.49 | 15.49 | 15.49 | 15.49 |
| Magnesium $C_{10}$-$C_{13}$ LAS | 1.55 | 1.55 | 1.55 | 1.55 | 1.55 | 1.55 | 1.55 |
| Sodium silicate | 3.56 | 3.56 | 3.56 | 3.56 | 3.56 | 3.56 | 3.56 |
| Sodium carbonate | 10.73 | 10.73 | 10.73 | 10.73 | 10.73 | 10.73 | 10.73 |
| Magnesium chloride - anhydrous | — | 0.40 | — | — | — | — | — |
| Calcium chloride - anhydrous | — | — | 1.85 | 1.94 | 1.85 | 1.81 | 1.81 |
| Glycerin | 1.50 | 1.50 | 1.50 | 1.50 | 1.50 | 1.50 | 1.50 |
| Lauryl/Myristylamidopropyl Dimethylamine Oxide | 0.83 | 0.83 | 0.83 | 0.83 | 0.83 | 0.83 | 0.83 |
| Sodium laureth sulfate (3EO) | 0.73 | 0.73 | 0.73 | 0.73 | 0.73 | 0.73 | 0.73 |
| Water, Fragrance, Color | Q.S. | Q.S. | Q.S. | Q.S. | Q.S. | Q.S. | Q.S. |
| Molar ratio: divalent salt/sodium silicate | NA | 0.25 | 0.97 | 1.02 | 0.97 | 0.95 | 0.95 |

Individual dishwashing paste composition samples are prepared by mixing the components above in a beaker using a stainless steel impeller, and placing the mixture into closed glass jars at room temperature. The compositions are allowed to harden for 3 months, with hardness values being measured daily in the first month, and then again at the second and third months. The hardness (penetrability) is monitored throughout the first few days. If the required hardness (5 mm penetrability) is not achieved, new batches with adjusted calcium carbonate and water levels are made to achieve a target hardness of 5 mm by the third day.

After each of these adjustments is made, hardness values are measured. The Control paste composition (C5) took seven (7) days to obtain penetrability below 8 mm, remaining close to a value of 1.55 mm hardness after 13 days. Examples 14 and 16-18 obtained penetrability below 8 mm after five (5) days, as well as higher penetrability (softer) in the long term, which was closer to the desired hardness of 5 mm. As such, Examples 14 and 16-18 did not exhibit "rock-like" texture after a few months' time, while the control (C5) reached "rock-like" texture within less than two (2) weeks. For reasons which are not immediately apparent, but possibly due to the lower relative levels of calcium carbonate used in the adjustments above, Example 15 did not harden.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A dishwashing paste composition, comprising:

from 30 wt.% to 40 wt.% of calcium carbonate as an abrasive;

a pH modifying agent in an amount effective to provide a pH greater than 7;

from 1 wt.% to 10 wt.% of sodium silicate as a structuring agent;

from 0.25 wt.% to 3 wt.% of magnesium chloride as a source of polyvalent cations; and a surfactant system consisting of from 5 wt.% to 20 wt.% of sodium $C_{10}$-$C_{13}$ alkylbenzenesulfonate (linear); and from 1 wt.% to 5 wt.% of magnesium $C_{10}$-$C_{13}$ alkylbenzenesulfonate (linear);

wherein the dishwashing paste composition has a penetrability of less than 8 mm after 3 days; and wherein the dishwashing paste composition maintains a penetrability of greater than about 3 mm after 90 days.

2. The dishwashing paste composition according to claim 1, wherein the pH modifying agent is selected from sodium carbonate, sodium bicarbonate, and a combination thereof.

3. The dishwashing paste composition according to claim 1, comprising from 1.5 wt.% to 7.5 wt.% of sodium silicate as the structuring agent.

4. The dishwashing paste composition according to claim 1, comprising from 2 wt.% to 6 wt.% of sodium silicate as the structuring agent.

5. The dishwashing paste composition according to claim 1, wherein the molar ratio of pH modifying agent to sodium silicate as the structuring agent is greater than 4:1.

6. The dishwashing paste composition according to claim 1, wherein the molar ratio of pH modifying agent to sodium silicate as the structuring agent is 4.4:1 or greater.

7. The dishwashing paste composition according to claim 1, wherein the molar ratio of magnesium chloride as the source of polyvalent cations to sodium silicate as the structuring agent is from 1:1 to 2:1.

8. The dishwashing paste composition according to claim 1, wherein the molar ratio of magnesium chloride as the source of polyvalent cations to sodium silicate as the structuring agent is 1.7:1.

9. The dishwashing paste composition according to claim 1, wherein the dishwashing paste composition provides a penetrability of less than 6 mm after 7 days.

10. The dishwashing paste composition according to claim 1, wherein the dishwashing paste composition provides a penetrability of 4 mm after 90 days.

11. A method of manufacturing a dishwashing paste composition according to claim 1, comprising the steps of:

providing an abrasive, a pH modifying agent, a structuring agent; and a source of polyvalent cations comprising an alkaline earth metal salt selected from magnesium chloride, calcium chloride, and a combination thereof;

admixing the abrasive, the pH modifying agent, the structuring agent; and the source of polyvalent cations in amounts sufficient to provide a pH of greater than 7, and for a time sufficient to ensure intimate contact between the structuring agent and the source of polyvalent cations;

wherein the dishwashing paste composition has a penetrability of less than 8 mm after 3 days; and wherein the dishwashing paste composition maintains a penetrability of greater than 3 mm after 90 days;

optionally, wherein the time sufficient to ensure intimate contact between the structuring agent and the source of polyvalent cations, is sufficient to ensure silica polymerization.

12. The method according to claim 11, wherein the structuring agent comprises sodium silicate.

* * * * *